US011986139B2

(12) United States Patent
DeJonge et al.

(10) Patent No.: US 11,986,139 B2
(45) Date of Patent: May 21, 2024

(54) EXTRACTION CLEANER WITH STEAM

(71) Applicant: BISSELL Inc., Grand Rapids, MI (US)

(72) Inventors: Mitchell J. DeJonge, Fruitport, MI (US); Ryan J. Alt, Byron Center, MI (US); Steve M. Johnson, Hudsonville, MI (US)

(73) Assignee: BISSELL Inc., Grand Rapids, MI (US)

( * ) Notice: Subject to any disclaimer, the term of this patent is extended or adjusted under 35 U.S.C. 154(b) by 0 days.

(21) Appl. No.: 18/100,607

(22) Filed: Jan. 24, 2023

(65) Prior Publication Data

US 2023/0240501 A1 Aug. 3, 2023

Related U.S. Application Data

(60) Provisional application No. 63/305,723, filed on Feb. 2, 2022.

(51) Int. Cl.

| | |
|---|---|
| ***A47L 11/40*** | (2006.01) |
| ***A47L 11/30*** | (2006.01) |
| ***A47L 11/34*** | (2006.01) |

(52) U.S. Cl.

CPC ..... *A47L 11/4086* (2013.01); *A47L 11/302* (2013.01); *A47L 11/34* (2013.01); *A47L 11/4008* (2013.01); *A47L 11/4011* (2013.01); *A47L 11/4016* (2013.01); *A47L 11/4041* (2013.01); *A47L 11/4083* (2013.01); *A47L 11/4088* (2013.01)

(58) Field of Classification Search

CPC .... A47L 11/4086; A47L 11/302; A47L 11/34; A47L 11/4008; A47L 11/4011; A47L 11/4016; A47L 11/4041; A47L 11/4083; A47L 11/4088; A47L 11/4036; F22B 1/285

See application file for complete search history.

(56) References Cited

U.S. PATENT DOCUMENTS

| | | | |
|---|---|---|---|
| 3,491,398 | A | 1/1970 | Segesman |
| 3,559,220 | A | 2/1971 | Thompson et al. |
| 4,498,214 | A | 2/1985 | Oxel |
| 4,733,430 | A | 3/1988 | Westergren |
| 5,493,752 | A | 2/1996 | Crouser et al. |
| 5,860,188 | A | 1/1999 | Maurer et al. |
| 5,958,113 | A | 9/1999 | Collins et al. |
| 5,983,442 | A | 11/1999 | Louis et al. |
| 6,446,302 | B1 | 9/2002 | Kasper et al. |
| 6,571,421 | B1 | 6/2003 | Sham et al. |

(Continued)

FOREIGN PATENT DOCUMENTS

| | | | |
|---|---|---|---|
| CN | 105708387 | A | 6/2016 |
| CN | 110338719 | A | 10/2019 |

(Continued)

*Primary Examiner* — David Redding

(74) *Attorney, Agent, or Firm* — Warner Norcross + Judd LLP

(57) ABSTRACT

An extraction cleaner includes a steam delivery system, a liquid delivery system, and a recovery system, and includes multiple cleaning modes, including a first cleaning mode in which components of the steam delivery system, liquid delivery system, and recovery system are active, a second cleaning mode in which components of the delivery system and recovery system are active, and a third cleaning mode in which components of the steam delivery system are active. Methods for operating an extraction cleaner are also provided.

20 Claims, 5 Drawing Sheets

(56) References Cited

U.S. PATENT DOCUMENTS

| | | | |
|---|---|---|---|
| 6,572,711 | B2 | 6/2003 | Sclafani et al. |
| 6,640,383 | B2 | 11/2003 | Tsen |
| 6,842,942 | B2 | 1/2005 | Morgan et al. |
| 6,934,995 | B2 | 8/2005 | Wheeler et al. |
| 7,048,804 | B2 | 5/2006 | Kisela et al. |
| 7,137,169 | B2 | 11/2006 | Murphy et al. |
| 7,146,679 | B2 | 12/2006 | Coates et al. |
| 7,617,563 | B2 | 11/2009 | Hertrick et al. |
| 7,640,626 | B2 | 1/2010 | Oh |
| 7,673,370 | B2 | 3/2010 | Frederick et al. |
| 7,752,705 | B2 | 7/2010 | McDowell et al. |
| 7,937,801 | B2 | 5/2011 | Egler et al. |
| 8,056,181 | B2 | 11/2011 | Kim et al. |
| 8,087,123 | B2 | 1/2012 | Merz |
| 8,528,161 | B2 | 9/2013 | Vrdoljak et al. |
| 8,627,543 | B2 | 1/2014 | Vrdoljak et al. |
| 8,695,159 | B2 | 4/2014 | Van Der Kooi et al. |
| 8,752,236 | B2 | 6/2014 | Oh et al. |
| 9,155,440 | B2 | 10/2015 | Nuttall et al. |
| 9,173,536 | B2 | 11/2015 | Van Der Kooi et al. |
| 9,265,394 | B2 | 2/2016 | Van Der Kooi et al. |
| 9,351,618 | B2 | 5/2016 | Van Der Kooi et al. |
| 9,351,623 | B2 | 5/2016 | Carter |
| 9,414,728 | B2 | 8/2016 | Van Der Kooi et al. |
| 9,968,231 | B2 | 5/2018 | Bassett et al. |
| 9,968,235 | B2 | 5/2018 | Vail et al. |
| 9,999,332 | B2 | 6/2018 | Braendle et al. |
| 10,130,230 | B2 | 11/2018 | Moser et al. |
| 10,130,237 | B2 | 11/2018 | Innes et al. |
| 10,188,252 | B2 | 1/2019 | Nguyen et al. |
| 10,349,797 | B2 | 7/2019 | Moser et al. |
| 10,376,124 | B2 | 8/2019 | McDowell et al. |
| 10,413,143 | B2 | 9/2019 | Van Der Kooi et al. |
| 10,448,800 | B2 | 10/2019 | Weeks et al. |
| 10,602,903 | B2 | 3/2020 | Johnson et al. |
| 10,694,914 | B2 | 6/2020 | McGee |
| 10,856,715 | B2 | 12/2020 | Van Der Kooi et al. |
| 10,881,258 | B2 | 1/2021 | Moser et al. |
| 10,932,644 | B2 | 3/2021 | Vrdoljak et al. |
| 10,959,590 | B2 | 3/2021 | Moser et al. |
| 11,045,062 | B2 | 6/2021 | Innes et al. |
| 2002/0042965 | A1 | 4/2002 | Salem et al. |
| 2002/0112744 | A1 | 8/2002 | Besseling |
| 2002/0170137 | A1 | 11/2002 | Coates et al. |
| 2003/0051306 | A1 | 3/2003 | Morgan et al. |
| 2003/0051308 | A1 | 3/2003 | Morgan et al. |
| 2003/0051309 | A1 | 3/2003 | Morgan et al. |
| 2003/0051310 | A1 | 3/2003 | Morgan et al. |
| 2003/0226230 | A1 | 12/2003 | Hertrick et al. |
| 2004/0111822 | A1 | 6/2004 | Syu |
| 2004/0134016 | A1 | 7/2004 | Kisela et al. |
| 2004/0221415 | A1 | 11/2004 | Tondra et al. |
| 2005/0076467 | A1 | 4/2005 | Stephens et al. |
| 2005/0091782 | A1 | 5/2005 | Gordon et al. |
| 2005/0132523 | A1 | 6/2005 | Kegg et al. |
| 2005/0144751 | A1 | 7/2005 | Kegg et al. |
| 2005/0223897 | A1 | 10/2005 | Ponjican et al. |
| 2005/0283936 | A1 | 12/2005 | Barker et al. |
| 2006/0123581 | A1 | 6/2006 | O'Neal |
| 2006/0123584 | A1 | 6/2006 | O'Neal |
| 2006/0123587 | A1 | 6/2006 | Parr et al. |
| 2007/0186370 | A1 | 8/2007 | Oh et al. |
| 2008/0301900 | A1 | 12/2008 | Choi et al. |
| 2009/0165822 | A1 | 7/2009 | Kinitz et al. |
| 2012/0047677 | A1 | 3/2012 | Paliobeis et al. |
| 2012/0047680 | A1 | 3/2012 | Chaney |
| 2012/0066858 | A1 | 3/2012 | Krondorfer et al. |
| 2012/0066859 | A1 | 3/2012 | Louis et al. |
| 2012/0066861 | A1 | 3/2012 | Louis et al. |
| 2013/0091652 | A1 | 4/2013 | Henderson et al. |
| 2013/0111693 | A1 | 5/2013 | Krondorfer et al. |
| 2014/0053363 | A1 | 2/2014 | Barlotti et al. |
| 2014/0208536 | A1 | 7/2014 | Ni |
| 2014/0215749 | A1 | 8/2014 | Van Der Kooi et al. |
| 2014/0259514 | A1 | 9/2014 | Vail et al. |
| 2016/0157693 | A1 | 6/2016 | Hess et al. |
| 2016/0345795 | A1 | 12/2016 | Manning |
| 2017/0127900 | A1 | 5/2017 | Wright et al. |
| 2019/0082906 | A1 | 3/2019 | Conrad |
| 2019/0183300 | A1 | 6/2019 | Yuen et al. |
| 2019/0183311 | A1 | 6/2019 | Diana et al. |
| 2019/0357748 | A1 | 11/2019 | McDowell et al. |
| 2020/0022550 | A1 | 1/2020 | Amoretti |
| 2020/0046196 | A1 | 2/2020 | Weeks et al. |
| 2020/0205636 | A1 | 7/2020 | Johnson et al. |
| 2020/0214526 | A1 | 7/2020 | Huang et al. |
| 2021/0169294 | A1 | 6/2021 | Pruiett et al. |

FOREIGN PATENT DOCUMENTS

| | | | |
|---|---|---|---|
| CN | 110353560 | A | 10/2019 |
| DE | 29508713 | U1 | 8/1995 |
| DE | 19522893 | A1 | 2/1996 |
| DE | 202015009606 | U1 | 7/2018 |
| DE | 102017120736 | A1 | 3/2019 |
| EP | 1132037 | A2 | 9/2001 |
| EP | 1603446 | B1 | 6/2010 |
| EP | 2229865 | B1 | 6/2012 |
| EP | 2835088 | A1 | 2/2015 |
| EP | 2521477 | B1 | 10/2015 |
| EP | 3203893 | B1 | 6/2020 |
| EP | 3016565 | B1 | 7/2020 |
| EP | 3750460 | A1 | 12/2020 |
| EP | 3016566 | B1 | 12/2022 |
| FR | 2661339 | A1 | 10/1991 |
| GB | 2545725 | A | 6/2017 |
| GB | 2588436 | A | 4/2021 |
| IT | BO20100759 | A1 | 6/2012 |
| WO | 2008096950 | A1 | 8/2008 |
| WO | 13055364 | A1 | 4/2013 |
| WO | 16087812 | A1 | 6/2016 |
| WO | 2016191624 | A1 | 12/2016 |
| WO | 2019048496 | A1 | 3/2019 |
| WO | 2020048851 | A1 | 3/2020 |
| WO | 20198211 | A1 | 10/2020 |
| WO | 21130103 | A1 | 7/2021 |
| WO | 21130332 | A1 | 7/2021 |

EXTRACTION CLEANER WITH STEAM

CROSS-REFERENCE TO RELATED APPLICATION(S)

The present application claims the benefit of U.S. Provisional Application No. 63/305,723, filed Feb. 2, 2022, which is incorporated herein by reference in its entirety.

BACKGROUND

Several different categories of apparatuses are known for "wet" cleaning surfaces. One category includes extraction cleaners for deep cleaning carpets and other fabric surfaces, such as upholstery. Extraction cleaners have a liquid delivery system and a liquid recovery system. The liquid delivery system typically includes a supply tank for storing a supply of cleaning liquid, a distributor for applying the cleaning liquid to the surface to be cleaned, and a liquid supply conduit for delivering the cleaning liquid from the supply tank to the distributor. The liquid recovery system usually comprises a recovery tank, a nozzle adjacent the surface to be cleaned and in fluid communication with the recovery tank through a working air conduit, and a source of suction in fluid communication with the working air conduit to draw the cleaning liquid from the surface to be cleaned and through the nozzle and the working air conduit to the recovery tank. Extraction cleaners sometimes incorporate an in-line heater that can heat the cleaning liquid to a temperature less than boiling. While extraction cleaners are effective, standard extraction cleaners may not treat all stain types equally well.

Another category of "wet" cleaning apparatuses includes steam mops that are typically configured for cleaning hard surfaces, such as bare flooring, including tile, hardwood, laminate, vinyl, and linoleum, as well as countertops, stove tops and the like. Typically, steam mops comprise at least one liquid supply tank for storing water that is fluidly connected to a selectively engageable pump or valve. The outlet of the pump or valve is fluidly connected to a steam generator, which comprises a heating element for heating the liquid. The steam generator produces steam, which can be directed towards the surface to be cleaned through a steam distributor. Steam is typically applied to the backside of a cleaning pad that is attached to the apparatus. Steam eventually saturates the cleaning pad and the damp pad is wiped across the surface to be cleaned to remove debris present on the surface. One drawback to these steam apparatuses is that they are typically not suitable for soft surfaces.

BRIEF SUMMARY

An extraction cleaner with steam delivery is provided herein. Aspects of the disclosure relate to an improved extraction cleaner with multiple cleaning modes.

According to one aspect of the disclosure, an extraction cleaner includes a fluid recovery system including a suction nozzle, a recovery container, and a vacuum motor, a fluid supply container configured to store a supply of a cleaning fluid, a steam delivery system including a heater in fluid communication with the fluid supply container and a steam distributor, a liquid delivery system including a liquid dispenser, and a user interface on the housing to select one of a plurality of modes of operation, the plurality of modes of operation including a first cleaning mode in which liquid is dispensed from the liquid dispenser and steam is dispensed from the steam distributor, a second cleaning mode in which liquid is dispensed from the liquid dispenser and steam is not dispensed from the steam distributor, and a third cleaning mode in which steam is dispensed from the steam distributor and liquid is not dispensed from the liquid dispenser.

According to another aspect of the disclosure, methods for operating the extraction cleaner are provided.

These and other features and advantages of the present disclosure will become apparent from the following description of particular embodiments, when viewed in accordance with the accompanying drawings and appended claims.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. In addition, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components. Any reference to claim elements as "at least one of X, Y and Z" is meant to include any one of X, Y or Z individually, and any combination of X, Y and Z, for example, X, Y, Z; X, Y; X, Z; and Y, Z.

BRIEF DESCRIPTION

Figure 1:
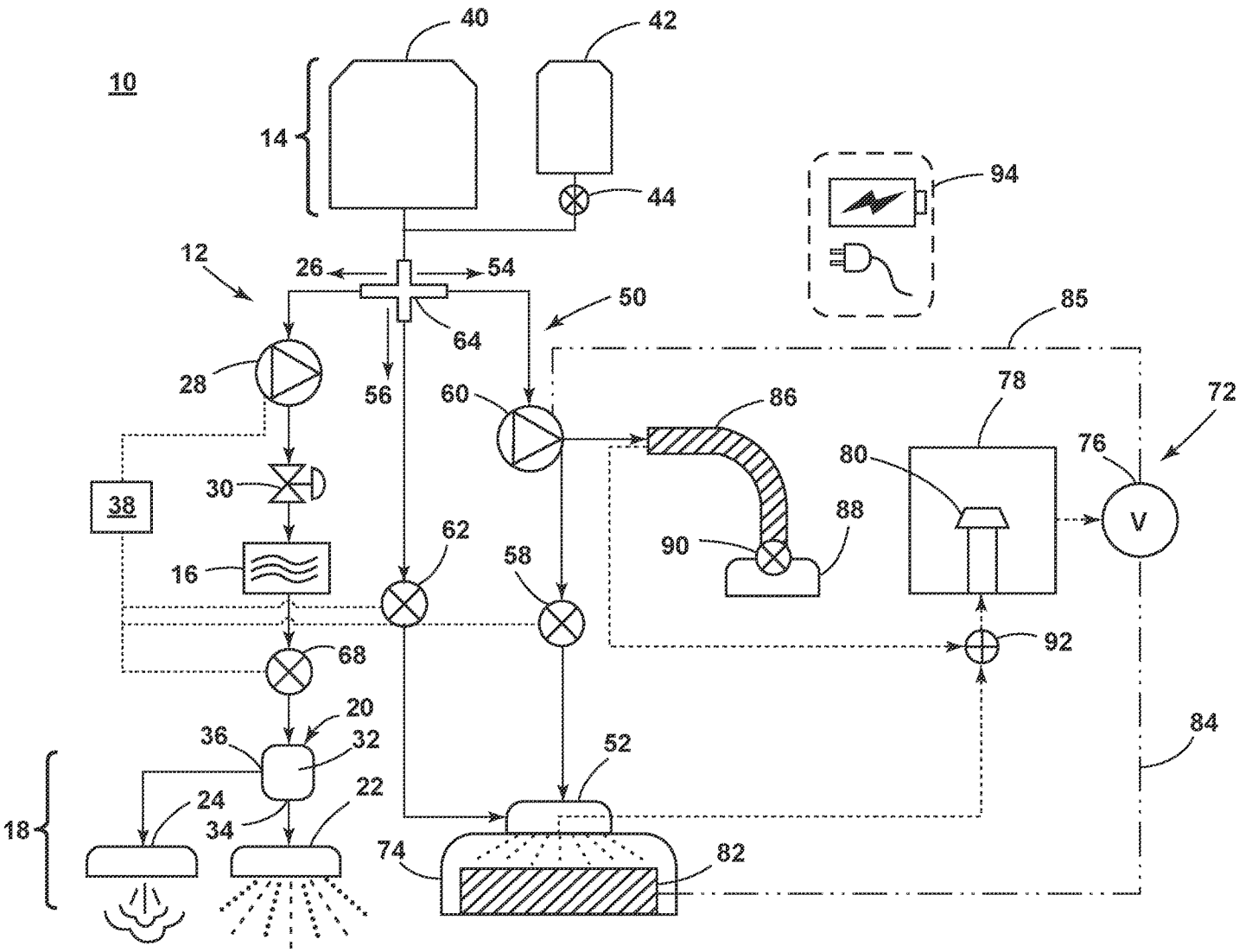
FIG. 1 is a schematic view of a surface cleaning apparatus in the form of an extraction cleaner.

The present disclosure generally relates to an extraction cleaner that includes a steam delivery system. Aspects of the disclosure relate to an improved extraction cleaner with multiple, user-selectable cleaning modes.

As used herein, the term "dirt" includes dirt, soil, dust, hair, stains, and other debris, unless otherwise noted.

As used herein, the term "cleaning fluid" may encompass liquid, steam, or a mixture of both liquid and steam, and may include the presence of a surface cleaning and/or treatment agent.

As used herein, the term "heated fluid" includes liquid, steam, or a mixture of both liquid and steam heated to around 100±10° C., alternately about 90 to 100° C., alternatively about 95 to 98° C. The heated fluid may be produced by heating a cleaning fluid with a heat source on board the extraction cleaner. The heated fluid can include at least some liquid and at least some steam, e.g. a liquid phase and a vapor phase. For example, the heated fluid can have a steam quality of around about 20% to about 30%, and in some aspects about 24%. As used herein, "steam quality" is the proportion of saturated steam in a saturated condensate (liquid) and steam mixture. For example, saturated steam vapor has a steam quality of 100%, and saturated liquid has a steam quality of 0%.

As used herein, the term "heated liquid" includes a liquid, such as but not limited to water or solutions containing water (like water mixed with a cleaning chemistry, fragrance, etc.), heated to around 100±10° C., alternately about 90 to 100° C., alternatively about 95 to 98° C. The heated liquid can include at least some steam, or substantially not steam. For example, the heated liquid can have a steam quality of around 20 to 30%, alternately about 24%. In other examples, the heated liquid can have a steam quality below 20%, including a steam quality near or at 0%.

As used herein, the term "unheated liquid" includes a liquid, such as but not limited to water or solutions containing water (like water mixed with a cleaning chemistry, fragrance, etc.), having a temperature below the temperature of heated liquid, including but not limited to 32 to 55° C. The unheated liquid may or may not be heated by a heat source on board the extraction cleaner apparatus. The unheated liquid may have a steam quality of 0%.

As used herein, the term "steam" includes a liquid, such as but not limited to water or solutions containing water (like water mixed with a cleaning chemistry, fragrance, etc.), at least partially converted to a gas or vapor phase. The liquid can be boiled or otherwise at least partially converted to the gas or vapor phase by heating or mechanical action like nebulizing. The steam can be invisible to the naked eye, in the form of a visible vapor that can be observed by the naked eye, or combinations thereof.

As used herein, the terms "visible vapor," "visible steam," or "visible steam vapor" includes steam that can be observed by the naked eye and is therefore visible to a user of the extraction cleaner.

The functional systems of the extraction cleaner can be arranged into any desired configuration, such as an upright device having a base and an upright body for directing the base across the surface to be cleaned, a canister device having a cleaning implement connected to a wheeled base by a vacuum hose, a lift-off floor cleaner (e.g., a floor cleaner capable of being used as an upright-type cleaner as well as a canister type cleaner), a portable or hand-held device adapted to be hand carried by a user for cleaning relatively small areas, an unattended surface cleaner, such as an unattended spot cleaning apparatus, or an autonomous/robotic device. At least some of the aforementioned cleaners can be adapted to include a flexible vacuum hose, which can form a portion of a working air path between a nozzle and a suction source.

FIG. 1 is a schematic view of various functional systems of an extraction cleaner 10 according to one aspect of the disclosure. The extraction cleaner 10 can include a fluid delivery system 12 including a source of cleaning fluid 14, a heater 16 for heating the cleaning fluid, and a steam distributor 18. The extraction cleaner 10 also includes a liquid delivery system 50 to deliver liquid to the surface to be cleaned and a recovery system 72 to remove liquid and/or dirt from the surface to be cleaned and storing the spent cleaning fluid and dirt.

In some embodiments, the steam distributor 18 is a dual-phase distributor including a phase separator 20 that separates a vapor phase of the heated fluid from a liquid phase thereof. A heated liquid outlet 22 dispenses heated liquid and a steam vapor outlet 24 dispenses steam vapor. In other embodiments, the steam distributor 18 does not separate phases of the heated fluid, and may dispense heated fluid through a steam distributor outlet, such as outlet 22. In other words, the phase separator 20 and separate steam vapor outlet 24 are not included in some embodiments of the extraction cleaner 10. In such an embodiment, the outlet 22 can dispense cleaning fluid heated by the heater 16, which may include liquid, steam, or a mixture of both liquid and steam heated to around 100±10° C., alternately about 90 to 100° C., alternatively about 95 to 98° C. Yet other configurations for the steam distributor 18 are possible. It is noted that, as used herein, the term "outlet" may encompass a single opening through which a fluid may pass or multiple openings through which a fluid may pass, unless otherwise noted.

The fluid delivery system 12 can include other conduits, ducts, tubing, hoses, connectors, valves, etc. fluidly coupling the components of the system 12 together and providing a supply path 26 from the source of cleaning fluid to the steam distributor 18. It is noted that the heated liquid outlet 22 and/or the steam vapor outlet 24 may include a single outlet opening or a plurality of outlet openings that collectively define an outlet.

The fluid source 14 can stored cleaning fluid in liquid form. The cleaning fluid can comprise one or more of any suitable cleaning fluids, including, but not limited to, water, compositions, concentrated detergent, diluted detergent, etc., and mixtures thereof. For example, the cleaning fluid can comprise water. In another example, the cleaning fluid can comprise a mixture of water and concentrated detergent.

The fluid delivery system 12 can include a flow controller to control the flow of fluid from the source 14 to the heater 16. In one configuration, the flow controller can comprise a pump 28 that pressurizes the path 26 and controls the delivery of heated fluid to the steam distributor 18. The pump 28, also referred to herein as a first pump or a steam pump, can be a mechanical or electrical component. In one example, the pump 28 can be a centrifugal pump. In another example, the pump 28 can be a solenoid pump.

In some embodiments, the pump 28 can have multiple speeds and/or flow rates so that a flow rate of cleaning fluid out of the steam distributor 18 can be varied. The extraction cleaner 10 can have an input control (not shown) that controls the speed and/or flow rate of the pump 28.

A pressure relief device 30 in the supply path 26 between the fluid source 14 and the heater 16 controls or limits the pressure in the steam delivery system 12. The pressure relief device 30 opens at a predetermined set positive pressure to protect the system 12 from being subjected to high pressures that exceed their design criteria. When the set pressure is met or exceeded, the pressure relief device 30 opens and vents steam outside the apparatus 10. Aside from this function, the pressure relief device 30 is not particularly limited, and may comprise any components and/or configurations suitable for use in/as a pressure relief. In one embodiment, the pressure relief device 30 is a spring valve that opens at a predetermined set pressure. In one non-limiting example, the pressure relief device 30 can vent steam directly to the surface underneath the apparatus 10.

During steam generation, pressure will build in the system 12 unless the pressure is released. Pressure is released, for example, when steam is dispensed from the steam distributor 18. When there is a blockage in the steam path 26, or if steam is otherwise held within the steam path 26 for a period of time, pressure will build in the in the system 12 as liquid is heated and steam is generated. When the pressure in the system 12 reaches the set pressure, the pressure relief device 30 opens. Once pressure in the system 12 drops below the set pressure, such as may occur if steam is released or if the extraction cleaner 10 is powered off for a period of time, the pressure relief device 30 closes.

The set pressure may be, for example, about 3 PSI to about 5 PSI, alternatively about 4 PSI, alternatively about 5 PSI, although it is understood that the set pressure may vary depending on the design limits of the extraction cleaner 10. In some embodiments, the pressure relief device 30 can be configured to begin opening when the set pressure is reached and then fully open when a second predetermined pressure, greater than the set pressure, is reached. For example, the pressure relief device 30 can be configured to begin to open when the pressure reaches about 5 PSI and fully open when the pressure reaches about 10 PSI.

The heater 16 preferably heats the cleaning fluid to about 100° C., where "about" includes ±10° C. This temperature may be the temperature at an outlet of the heater 16. The heater 16 itself may operate at a higher temperature, such as about 120° C. to about 190° C., alternatively about 140° C. to about 180° C. Some heat loss between the heater 16 and the phase separator 20 is possible, particularly when the system and its components are heating up and pressurizing. Once a "steady state" is reached, the heated liquid may be about 90° C. to about 100° C., alternatively about 95° C. to about 98° C., measured at the phase separator 20. Some non-limiting examples of a suitable heater 16 include, but are not limited to, a flash heater, a boiler, an immersion heater, and a flow-through steam generator.

Prior to reaching the phase separator 20, the heated liquid may include cleaning fluid in a mixture of vapor phase and liquid phase. For example, the heated liquid output by the heater 16 can have a steam quality of about 20% to about 30%, alternately about 24%.

It is noted that the steam quality of the heated fluid that reaches the phase separator 20 may change over time, for example depending on how long a trigger 38 or other control actuator is depressed. When the trigger 38 is initially depressed, the steam quality may be higher and may decrease until a steady state is reached.

The phase separator 20 can include a chamber 32, a liquid discharge port 34, and a vapor discharge port 36. The phase separator 20 can use gravity to cause denser cleaning fluid, e.g. heated liquid, to settle toward the bottom of the chamber 32 and less dense cleaning fluid, e.g. vapor, to rise toward the top of the chamber 32. The liquid that settles can drain by gravity through the liquid phase discharge port 34. The vapor phase discharge port 36 can be positioned higher than the liquid phase discharge port 34 so that liquid does not exit through the vapor phase discharge port 36. The separated steam vapor is pushed out of the vapor phase discharge port 36 by pressure generated within the heater 16 and, optionally, by pressure generated by the pump 28. Examples of suitable phase separators are disclosed in U.S. Patent Application No. 63/297,851, filed Jan. 10, 2022, which is incorporated herein by reference in its entirety. Other phase separators are possible.

In some embodiments, the phase separator 20 may be integrated with the heated liquid outlet 22 and/or the steam vapor outlet 24. In other embodiments, the phase separator 20 may be remote from a portion of the steam distributor 18 including the heated liquid outlet 22 and/or the steam vapor outlet 24. For example, the phase separator 20 can be located at a distance from the heated liquid outlet 22 and/or the steam vapor outlet 24, and require conduits, ducts, tubing, hoses, etc. routed through the extraction cleaner 10 to fluidly couple the discharge ports 34, 36 to the outlets 22, 24.

The liquid phase of the heated fluid dispensed by the heated liquid outlet 22 is substantially in a liquid state, and is preferably within a temperature range of about 90° C. to about 100° C., alternatively about 95° C. to about 98° C. Applying heated liquid within this temperature range is effective at cleaning soft surfaces such as carpet, while not being damaging to typical flooring surfaces. Other temperature ranges are possible, and may depend on one of more of the cleaning fluid, the type of surface to be cleaned (e.g. carpet vs. hard floor, wool carpet vs. nylon carpet), or the type of dirt to be removed from the surface to be cleaned.

The vapor phase of the heated fluid dispensed by the steam vapor outlet 24 is substantially in a gaseous state, and is preferably within a temperature range of about 90° C. to about 100° C., alternatively about 95° C. to about 98° C. Other temperature ranges for the vapor phase are possible depending on the cleaning fluid. The temperature of the vapor phase of the heated fluid dispensed by the steam vapor outlet 24 is generally similar in temperature to the liquid phase of the heated fluid dispensed by the heated liquid outlet 22, although some variation is possible.

The fluid source 14 can include at least one supply container 40 for storing a supply of cleaning fluid. In yet another configuration, the fluid delivery system 12 can have an additional supply container 42 for storing a liquid cleaning fluid. For example, the first supply container 40 can store water and the second supply container 42 can store a cleaning agent such as detergent. The supply containers 40, 42 can, for example, be defined by a supply tank and/or a collapsible bladder. Alternatively, a single container can define multiple chambers for different cleaning fluids. In another aspect, the fluid source 14 includes a single supply container 40.

In embodiments where multiple supply containers 40, 42 are provided, the system 12 can have a mixing system for controlling the composition of the cleaning fluid that is delivered to the surface. The composition of the cleaning fluid can be determined by the ratio of cleaning fluids mixed together by the mixing system. In one non-limiting example, the mixing system includes a mixing valve 44 fluidly coupled with an outlet of the second supply container 42, whereby when mixing valve 44 is open, the second cleaning fluid will mix with the first cleaning fluid flowing out of the first supply container 40. By controlling the time that the mixing valve 44 is open, the composition of the cleaning fluid that is delivered to the surface can be selected. Other mixing systems are possible, such as mixing systems with manifolds and controllable orifices.

As shown in FIG. 1, in one embodiment, the liquid delivery system 50 includes at least one liquid dispenser 52 supplied with liquid cleaning fluid from a source of cleaning fluid. The liquid delivery system 50 can share the same fluid source 14 as the fluid delivery system 12, e.g. the supply container 40 or dual supply containers 40, 42. In another embodiment, the extraction cleaner 10 can include a separate supply container (not shown) for storing a cleaning fluid for the liquid delivery system 50.

Regardless of the source of the cleaning fluid, the liquid delivery system 50 can include other conduits, ducts, tubing, hoses, connectors, valves, etc. fluidly coupling the components of the liquid delivery system 50 together and providing at least one liquid supply path from the source of cleaning fluid to a liquid dispenser 52. Optionally, in some embodiments, the extraction cleaner 10 has multiple liquid supply paths 54, 56 from the source of cleaning fluid to a liquid dispenser 52. A first liquid supply path 54 can deliver cleaning fluid at a first flow rate to the liquid dispenser 52 and a second liquid supply path 56 can deliver cleaning fluid at a second flow rate to the liquid dispenser 52. The first and second flow rates can be the same, or different. In one embodiment, the first flow rate can be higher than the second flow rate. In one aspect, one of the first or second liquid supply paths 54, 56 can be opened to deliver cleaning fluid at a first flow rate and both the first and second liquid supply paths can be opened to deliver cleaning fluid at a second flow rate, greater than the first flow rate. Utilizing two supply paths can be useful to provide the extraction cleaner 10 with cleaning modes having different flow rates, as described in further detail below.

The first liquid supply path 54 can be a pump-controlled supply path, and can include a pump 60 which pressurizes the path 56 and controls the delivery of liquid cleaning fluid to the liquid dispenser 52. The pump 60, also referred to herein as a second pump or a liquid pump, can be a mechanical or electrical component. In one example, the pump 60 can be a centrifugal pump. In another example, the pump 60 can be a solenoid pump. The first liquid supply path can include a first liquid valve 58 downstream of the pump 60, The second liquid supply path 56 can be a gravity-feed supply path controlled by a second liquid valve 62, whereby when the valve 62 is open, fluid will flow under the force of gravity to the liquid dispenser 52.

In another configuration of the fluid delivery system, rather than providing two supply paths, the extraction cleaner 10 can include the pump-controlled supply path 54, and the pump 60 can have multiple speeds and/or flow rates so that a flow rate of cleaning fluid out of the liquid dispenser 52 can be varied. The extraction cleaner 10 can have an input control that controls the speed and/or flow rate of the pump 60. For example, different cleaning modes can have an associated operating parameter for the pump 60, with the pump 60 operating at a first flow rate in one cleaning mode and operating at a second, higher flow rate in another cleaning mode. As will be described in further detail below, user-selection of a cleaning mode input control to select a desired cleaning mode can automatically change the speed and/or flow rate of the pump 60 to the speed and/or flow rate associated with the selected cleaning mode.

In embodiments where the fluid source 14 is shared, a manifold splitter 64 splits liquid between the supply paths 26, 54, 56. The manifold splitter 64 can include a first outlet in fluid communication with the steam supply path 26, including the heater 16 and the steam distributor 18, a second outlet in fluid communication with the first liquid supply path 54, including the valve 58 and the liquid dispenser 52, and a third outlet in fluid communication with the second liquid supply path 56, including the pump 60 and the liquid dispenser 52.

The liquid dispenser 52 can comprise any structure, such as a nozzle, a spray tip, or a manifold, and can include at least one liquid outlet for dispensing liquid cleaning fluid to the surface to be cleaned. The at least one outlet can be positioned to deliver liquid cleaning fluid directly to the surface to be cleaned, or indirectly by delivering liquid cleaning fluid onto an agitator (not shown). In one non-limiting example, the at least one outlet delivers liquid cleaning fluid between two horizontally-rotating brushrolls. In one non-limiting example, the liquid dispenser 52 is a spray manifold having multiple outlets.

In certain embodiments, the liquid provided to the liquid dispenser 52 does not pass through the heater 16 and/or is otherwise unheated, and is at the same temperature as the fluid source 14. In other embodiments, the liquid provided to the liquid dispenser 52 passes through a heater (not shown) or is otherwise heated to a temperature that is less than the temperature of the heated liquid dispensed by the heated liquid outlet 22. In yet another example, the cleaning fluid can be heated using exhaust air from a motor-cooling pathway for a motor/fan assembly.

With both the fluid delivery system 12 and the liquid delivery system 50, the extraction cleaner 10 can selectively deliver unheated liquid, heated liquid, and/or steam to the surface to be cleaned. Appropriate switches, buttons, actuators, and the like can be provided for user control of the systems 12, 50 including dispensing unheated liquid only, heated liquid and steam only, or a combination of unheated liquid, heated liquid, and steam simultaneously to the surface to be cleaned.

In one embodiment, the release of fluid from the steam distributor 18 and from the liquid dispenser 52 is effected by a trigger 38. The trigger 38 can operate the first liquid valve 58 in the first liquid path 54 and the second liquid valve 62 in the second liquid path 56 to release liquid from the liquid dispenser 52. The trigger 38 can operate a steam valve 68 and/or the steam pump 28 in the steam path 26 to release steam from the steam distributor 18. Release of the trigger 38 closes any open valves 58, 62, 68 and/or de-activates the steam pump 28 and stops dispensing.

As described in further detail below, in some embodiments, operation of the valves 58, 62, 68 upon depression of the trigger 38 can be mode-dependent. In other words, depending on a selected cleaning mode of the extraction cleaner 10, depression of the trigger 38 may or may not open one or more of the valves 58, 62, 68. For example, depending on the cleaning mode, operation of the trigger 38 may open the first liquid valve 58 only, the second liquid valve 62 only, the steam valve 68 only, activate the steam pump 28 only, or any combination thereof. In yet another embodiment, separate input controls can be provided to control the valves 58, 62, 68 and/or pump 28. A user may operate multiple controls at the same time to dispense liquid and steam at the same time.

Various locations and configurations for the valves 58, 62, 68 are possible. In one embodiment, the steam valve 68 is located in the supply path 26 between the heater 16 and the steam distributor 18. The first liquid valve 58 is located in the supply path 54 between the liquid pump 60 and the liquid dispenser 52. The second liquid valve 62 is located in the supply path 56 between the splitter 64 and the liquid dispenser 52. The valves 58, 62, 68 may be, for example any combination of solenoid valves or other electronic valves. Aside from the function of controlling fluid flow through the supply paths 26, 54, 56, the valves 58, 62, 68 are not particularly limited, and may comprise any components and/or configurations suitable for use in/as a fluid control valve. In one embodiment, the valves 58, 62, 68 are each solenoid valves.

In another embodiment, the liquid valves 58, 62 are solenoid valves and the steam valve 68 is a two-way solenoid valve. It is noted that, due to residual steam in the system, steam may continue to be dispensed after the trigger 38 is released and the steam valve 68 closes. Using a two-way solenoid valve for the steam valve 68 can substantially shorten the time steam continues to be dispensed after the trigger 38 is released. The two-way solenoid valve can vent into an outlet of the pressure relief device 30 within a short period of time (e.g., about 2 seconds) after the trigger 38 is released.

In yet another embodiment, the steam valve 68 is not provided in the steam supply path 26. In such an embodiment, the release of steam is controlled by activating and de-activating the steam pump 28. The trigger 38 can activate the steam pump 28 to release steam from the steam distributor 18 and de-activate the steam pump 38 to stop dispensing steam. As such, the steam valve 68 may be an optional component of the extraction cleaner 10.

The recovery system 72 can include a suction nozzle 74, a suction source including a vacuum motor 76 in fluid communication with the suction nozzle 74 for generating a working air stream, and a recovery container 78 for separating and collecting fluid and dirt from the working airstream for later disposal.

A separator 80 can be formed in a portion of the recovery container 78 for separating fluid and entrained dirt from the working airstream. The suction source is provided in fluid communication with the recovery container 78.

The suction nozzle 74 can be provided on a base or cleaning head adapted to move over the surface to be cleaned. An agitator 82 can be provided adjacent to the suction nozzle 74 for agitating the surface to be cleaned so that the dirt is more easily ingested into the suction nozzle 74. Some examples of agitators include, but are not limited to, a horizontally-rotating brushroll, dual horizontally-rotating brushrolls, one or more vertically-rotating brushrolls, or a stationary brush. In one non-limiting example, the agitator 82 is two horizontally-rotating brushrolls, and the liquid dispenser 52 delivers liquid cleaning fluid between the two horizontally-rotating brushrolls.

In the case of a moving agitator 82, a drive transmission 84 operably connects the agitator 82 with the vacuum motor 76 to transmit rotational motion of the motor 76 to the agitator 82. In other embodiments, a separate agitator motor can be provided for driving the agitator 82.

In some embodiments of the extraction cleaner 10, the liquid pump 60 is a mechanical component and is mechanically driven by the vacuum motor 76. A drive transmission 85 operably connects the liquid pump 60 with the vacuum motor 76 to transmit rotational motion of the motor 76 to the pump 60. Thus, the liquid pump 60 is activated when the vacuum motor 76 is activated. In one aspect, the liquid pump 60 can be a centrifugal pump having an impeller operably coupled with the vacuum motor 76 by a jack shaft. The steam pump 28 can be an electrical component and is driven by its own motor, and is therefore operable independently of the vacuum motor 76. In other embodiments, a separate pump motor can be provided for driving the liquid pump 60, so that it may activated independently of the vacuum motor 76.

Optionally, in some embodiments, the extraction cleaner 10 can also be provided with above-the-floor or hose cleaning features. As shown in FIG. 1, the extraction cleaner 10 can have a hose 86 and an accessory tool 88 for above-the-floor and spot cleaning of surfaces, including, but not limited to, upholstery, drapery, mattresses, area rugs, and vehicle interiors. The tool 88 can be in fluid communication with first liquid supply path 54 of the liquid delivery system 50 to selectively deliver cleaning liquid to the surface to be cleaned and can accordingly have a fluid distributor (not shown). A manually-operated valve 90 on the hose 86 or tool 88 can control the dispensing of cleaning liquid from the tool 88. The tool 88 can also be in fluid communication with the recovery system 72 to draw the cleaning liquid and dirt through the hose 86 and into the recovery tank 78, and can accordingly have a suction inlet (not shown). A diverter assembly 92 can selectively divert the recovery pathway between the recovery container 78 and either the suction nozzle 74 or the hose 86. Multiple different accessory tools 88 can be provided for different cleaning activities.

Electrical components of the extraction cleaner 10, including the heater 16, pumps 28, 60, valves 58, 62, 68, vacuum motor 76, or any combination thereof, are electrically coupled to a power source 94, which can comprise a power cord plugged into a household electrical outlet and/or a battery for cordless operation. Appropriate switches, buttons, actuators, and the like can be provided for user control of the electrical components, thereby controlling the systems 12, 50, 72 of the extraction cleaner 10. For example, cleaning modes can have associated operating parameters for the heater 16, pumps 28, 60, valves 58, 62, 68, vacuum motor 76, or any combination thereof, such that user selection of a cleaning mode will operate those components according to the associated operating parameters. The extraction cleaner 10 can output status information regarding the selected cleaning modes to the user.

The extraction cleaner 10 can have multiple, user-selectable cleaning modes. In one embodiment, the extraction cleaner 10 has a first cleaning mode in which liquid and steam are dispensed, a second cleaning mode in which liquid, and not steam, is dispensed, and a third cleaning mode in which steam, and not liquid, is dispensed. The first cleaning mode may also be referred to herein as a steam wash or "Max Clean" cleaning mode. The second cleaning mode may also be referred to herein as an express or "Quick Dry" cleaning mode. The third cleaning mode may also be referred to herein as a steam only or "Pre-Treat" cleaning mode.

In one embodiment of the first or steam wash cleaning mode, the vacuum motor 76, liquid pump 60, heater 16 are activated, and depression of the trigger 38 opens the first liquid valve 58 and activates the steam pump 28. In embodiments where the steam valve 68 is included in the supply path 26, depression of the trigger 38 can also open the steam valve 68. Liquid is dispensed at a first flow rate from the liquid dispenser 52 and steam is dispensed from the steam distributor 18. With the vacuum motor 76 on, the agitator 82 rotates to agitate the surface to be cleaned. The first cleaning mode can provide the greatest cleaning performance by the extraction cleaner 10, since the first flow rate of liquid is higher than in other cleaning modes, and the combination of liquid and steam delivery applies wet heat to the surface to be cleaned to improve dirt transportation away from the surface. Dirt is freed from the fibers of the soft surface with a combination of chemical and mechanical (e.g. via the agitator 82) interactions, allowing the creation of bonds between the dirt and cleaning fluid. The encapsulated dirt can then be removed from the fibers using suction via the nozzle 74.

In the first cleaning mode, the liquid dispenser 52 can dispense liquid cleaning fluid at a rate of about 1600 ml/min to about 2100 ml/min, alternatively about 1740 ml/min. The steam distributor 18 can dispense cleaning fluid at a rate of about 52 ml/min to about 90 ml/min, alternatively about 75 ml/min to about 80 ml/min. In embodiments where the steam distributor 18 includes the separate outlets 22, 24, a portion of the cleaning fluid is dispensed through the steam vapor outlet 24 as steam vapor, and the remainder is dispensed through the heated liquid outlet 22 as heated liquid droplets. For example, the heated liquid outlet 22 can dispense steam vapor at a rate of about 41 ml/min to about 72 ml/min, alternatively about 60 ml/min to about 64 ml/min, and the steam vapor outlet 24 can dispense steam vapor at a rate of about 10 ml/min to about 18 ml/min, alternatively at least about 12 ml/min, alternatively about 15 ml/min. Alternatively, the steam distributor 18 can dispense cleaning fluid at a rate of about 60 ml/min, with the heated liquid outlet 22 dispensing heated droplets at a rate of about 40 ml/min to about 45 ml/min and the steam vapor outlet 24 dispensing steam vapor at a rate of about 15 ml/min to about 25 ml/min steam.

In one embodiment of the second or express cleaning mode, the vacuum motor 76 is activated, and depression of the trigger 38 opens the second liquid valve 62. Liquid is dispensed at a second flow rate from the liquid dispenser 52, and the second flow rate is less than the first flow rate of the first liquid valve 58, as described with respect to the first (or steam wash) cleaning mode, as described above. Steam is not dispensed during the second cleaning mode, although the heater 16 may be on. Likewise, liquid is not dispensed through the first supply path 54, although the liquid pump 60 may be on. With the vacuum motor 76 on, the agitator 82 rotates to agitate the surface to be cleaned. The second cleaning mode can provide a faster drying time after a cleaning operation by the extraction cleaner 10 compared to the first cleaning mode, since the second flow rate of liquid is lower than the first flow rate of liquid in the first cleaning mode.

In the second cleaning mode, the liquid dispenser 52 can dispense liquid cleaning fluid at a rate of about 145 ml/min to about 185 ml/min.

In one embodiment of the third or steam only cleaning mode, the heater 16 is activated, and depression of the trigger 38 activates the steam pump 28. In embodiments where the steam valve 68 is included in the supply path 26, depression of the trigger 38 can also open the steam valve 68. Steam is dispensed from the steam distributor 18. During the third cleaning mode, the vacuum motor 76 and liquid pump 60 are off, and the agitator 82 does not rotate. The third cleaning mode can provide a pre-treatment of stains by the extraction cleaner 10. Using high temperature fluid is particularly efficient at removing embedded soils and stains on soft surfaces like carpet.

In the third cleaning mode, the steam distributor 18 can dispense cleaning fluid at substantially the same rate as the steam distributor 18 dispenses in the first cleaning mode. However, with the vacuum motor 76 off, the steam vapor outlet 24 can reliably produce visible steam, e.g., a visible vapor that can be observed by the naked eye. Producing visible steam offers a visual confirmation to the user that steam is being generated and dispensed by the extraction cleaner 10. With the vacuum motor 76 on in the first cleaning mode, steam vapor dispensed from the outlet 24 may not be observable as the suction generated by the vacuum motor 76 may draw the steam vapor into the suction nozzle 74 before the steam vapor can be observed by a user, such as almost immediately after the steam vapor is dispensed from the outlet 24.

Optionally, in embodiments where the extraction cleaner 10 is provided with above-the-floor or hose cleaning features, the extraction cleaner 10 can have a fourth cleaning mode in which cleaning fluid is dispensed through the hose 86 and tool 88. The fourth cleaning mode is also referred to herein as a hose or accessory cleaning mode.

In one embodiment of the fourth cleaning mode, the vacuum motor 76 and liquid pump 60 are activated, and liquid is dispensed from the tool 88 via the first supply path 54 by operation of the manually-operated valve 90. In one embodiment, the tool 88 can be provided with a trigger that a user can actuate to open the manually-operated valve 90 to dispense liquid from the tool 88.

Operation of the trigger 38 may be disabled in the fourth cleaning mode, such that depression of the trigger 38 does not open any of the valves 58, 62, 68 or activate the steam pump 28. As such, liquid is not dispensed from the liquid dispenser 52, although the liquid pump 60 may be on, and steam is not dispensed during the fourth cleaning mode, although the heater 16 may be on.

To operate in the fourth cleaning mode, the diverter assembly 92 can be manually actuated by the user to divert the recovery pathway to the hose 86. In another embodiment, the diverter assembly 92 can be automatically actuated upon user selection of the fourth cleaning mode.

Figure 2:
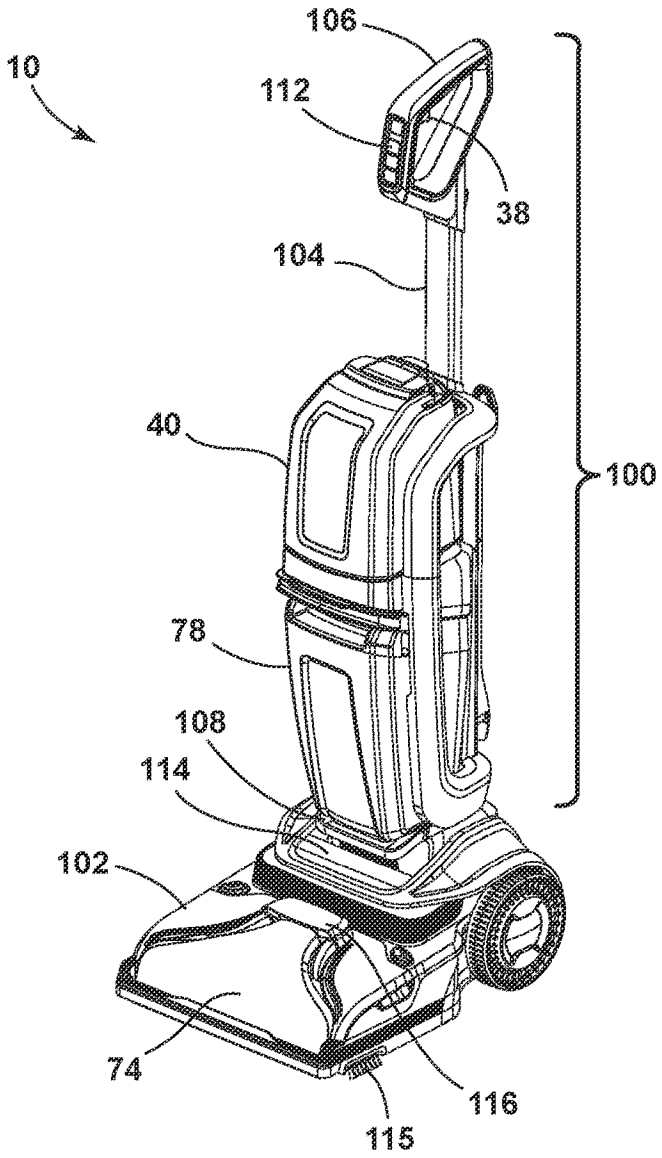
FIG. 2 is a perspective view of the extraction cleaning of FIG. 1 embodied as an upright extraction cleaner.

For an upright extraction cleaner, an upright assembly or handle may need to be in an upright or storage position, an example of which is shown in FIG. 2, to operate in the fourth cleaning mode. Parking the upright assembly or handle can operate a mechanism to lift the agitator 82 out of contact with the surface to be cleaned, so that the agitator 82 may continue rotating but not damage the surface. Alternatively, parking the upright assembly or handle can operate a mechanism to stop the brushroll from rotating. Additionally, in some embodiments, the extraction cleaner 10 must be in a particular cleaning mode, for example in the first or second cleaning mode, before being parked in order for the fourth cleaning mode to be operational. The extraction cleaner 10 may enter a stand-by mode upon being parked in the third or steam-only cleaning mode, in which the cleaner 10 remains powered on but no cleaning functions are active (e.g., the heater 16, the pumps 28, 60, and/or the vacuum motor 76 are turned off). To end the stand-by mode, the upright assembly or handle can be reclined.

Table 1 below lists some non-limiting examples of operating parameters for the cleaning modes. Other operating parameters for the cleaning modes and other cleaning modes are possible. As noted above, in all cleaning modes, the release of cleaning fluid (whether liquid, steam, or both) can be controlled by the trigger 38.

TABLE 1

| | Vacuum Motor (76) | Liquid Pump (60) | Heater (16) | Steam Pump (28) | First Liquid Valve (58) | Second Liquid Valve (62) | Steam Valve (68) |
|---|---|---|---|---|---|---|---|
| First Cleaning Mode | On | On | On | Trigger | Trigger | Off | Trigger |
| Second Cleaning Mode | On | On | On | Off | Off | Trigger | Off |
| Third Cleaning Mode | Off | Off | On | Trigger | Off | Off | Trigger |
| Fourth Cleaning Mode | On | On | On | Off | Off | Off | Off |

FIG. 2 shows the extraction cleaner 10 as an upright extraction cleaner having a housing that includes an upright assembly 100 that is pivotally connected to a base 102 for directing the base 102 across the surface to be cleaned. The extraction cleaner 10 can comprise the various systems and components schematically described for FIG. 1, including the fluid delivery system 12, the liquid delivery system 50, and the recovery system 72. The various systems and components schematically described for FIG. 1 can be supported by either or both the base 102 and the upright assembly 100.

For purposes of description related to the figures, the terms "upper," "lower," "right," "left," "rear," "front," "vertical," "horizontal," "inner," "outer," and derivatives thereof shall relate to the disclosure as oriented in FIG. 2 from the perspective of a user behind the extraction cleaner 10, which defines the rear of the extraction cleaner 10. However, it is to be understood that the disclosure may assume various alternative orientations, except where expressly specified to the contrary.

The extraction cleaner 10 can includes at least one user interface (UI) to accept user inputs for controlling the cleaning systems, function as a communication output device for the cleaning systems, and/or provide an improved user experience. In one embodiment, the extraction cleaner 10 may include a first UI 112 and a second UI 114 to accept user inputs for controlling the cleaning systems, function as a communication output device for the cleaning systems, and/or provide an improved user experience.

The upright assembly 100 includes a handle 104 having a grip 106, and the trigger 38 may be provided on the grip 106 in a location to be depressed by a finger of the user's hand holding the grip 106. The trigger 38 can conveniently be located adjacent to the grip 106 and the UI 112. For example, a user may operate the trigger 38 using the forefinger of the same hand holding the grip 106. Conveniently, in one arrangement, the UI 112 is disposed on a front side of the grip 106 and the trigger 38 is disposed on a rear side of the grip 106. While a trigger is shown, various other forms for the dispensing input control are possible.

The upright assembly 100 can comprise any type of elongated handle, wand, body, or combination thereof suitable for the purposes described herein, including for a user to maneuver the cleaner 10 over a floor surface to be cleaned. In one embodiment, the upright assembly 100 includes a main support section or frame supporting components of the systems 12, 50, 72, including, but not limited to, the recovery container 78 and the supply container 40. Other components of the upright assembly 100 may include, but are not limited to, the heater 16, pumps 28, 60, vacuum motor 76, and the like, or any combination thereof.

The base 102 can comprise any type of base, foot, or cleaning head suitable for the purposes described herein, including being moved over a floor surface to be cleaned. In one embodiment, the base 102 includes a base housing supporting components of the systems 12, 50, 72, including, but not limited to the steam distributor 18, the liquid dispenser 52, the suction nozzle 74, and the agitator 82. Wheels 110 can at least partially support the base 102 for movement over the surface to be cleaned. Other components of the base 102 may include, but are not limited to, the heater 16, pumps 28, 60, a motor for driving the agitator 82, edge brushes 115, a hose port 116 for selectively coupling the hose 86 (FIG. 1) to the extraction cleaner 10, and the like, or any combination thereof.

A moveable joint assembly 108 can connect the base 102 to the upright body 100 for movement of the upright body 100 about at least one axis. In the embodiment shown herein, the upright body 100 can pivot up and down about at least one axis relative to the base 102. The joint assembly 108 can alternatively comprise a universal joint, such that the upright body 100 can swivel about its longitudinal axis in addition to pivoting relative to the base 102. The upright body 100 can pivot, via the joint assembly 108, between an upright or storage position, an example of which is shown in FIG. 2, and a reclined or use position in which the upright body 100 is pivoted rearwardly to form an acute angle with the surface to be cleaned. Wiring and/or conduits can optionally supply electricity, air, liquid and/or steam between the upright body 100 and the base 102, or vice versa, and can extend though the joint assembly 108. As such, in some embodiments, a portion of the cleaning systems 12, 50, 72 can extend through the joint assembly 108.

A joint lock (not shown) can selectively engage and lock the upright body 100 in an upright or storage position, an example of which is shown in FIG. 2, relative to the base 102. When locked in the upright/storage position, the joint assembly 108 is locked-out and the upright body 100 is not moveable about the at least one axis. When reclined, the moveable joint assembly 108 is released and the upright body 100 can move relative to the base 102 about the at least one axis. Aside from this function, the joint lock is not particularly limited, and may comprise any components and/or configurations suitable for use in/as a joint lock. In one embodiment, the joint lock is a detent mechanism. The detent mechanism can be configured to automatically engage by the action of raising the upright body 100 to the upright storage position. A user can disengage the detent mechanism to recline the upright body 100, for example, by pressing down on the base 102 while pulling the upright body 100 rearwardly. In one example, the base 102 can include an actuator, such as a pedal, button, or lever, that a user may press to disengage the detent mechanism.

Figure 3:
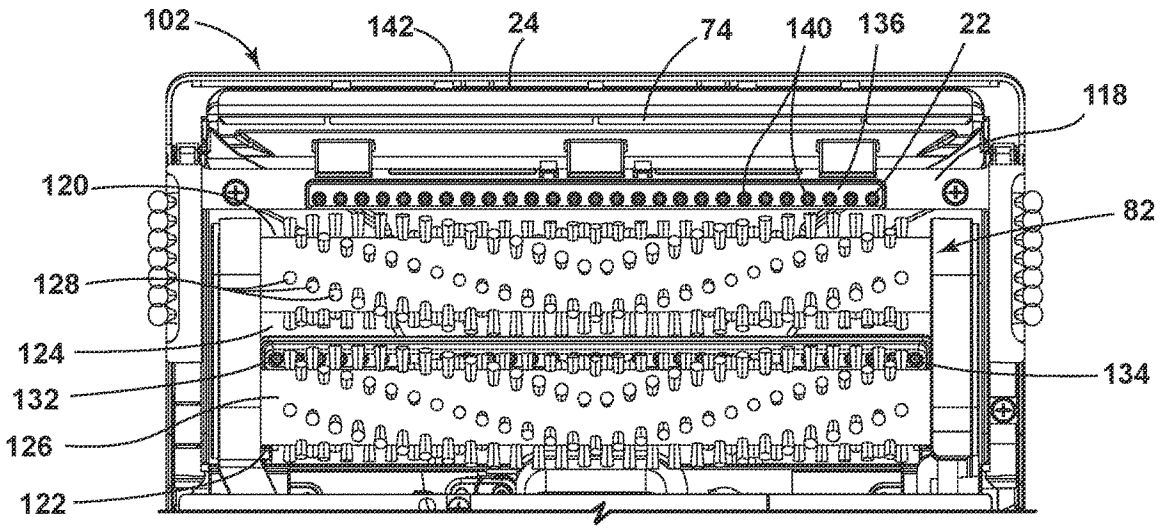
FIG. 3 is a bottom view of a front portion of a base for the extraction cleaner from FIG. 2.

FIG. 3 is a bottom view of a front portion of the base 102, generally showing an underside 118 of the base 102. The agitator 82 of the illustrated embodiment includes dual horizontally-rotating brushrolls, including a forward brushroll 120 and a rearward brushroll 122, and which are located in a brush chamber 124 on the base 102.

In one embodiment, the brushrolls 120, 122 comprise dowels 126 supporting at least one agitation element. The agitation element can comprise a plurality of bristles 128 extending from the dowel 126. Bristles 128 can be tufted or unitary bristle strips and constructed of nylon, or any other suitable synthetic or natural fiber. In another embodiment, the agitation element can comprise microfiber material provided in addition to or instead of the bristles 128.

Figure 4:
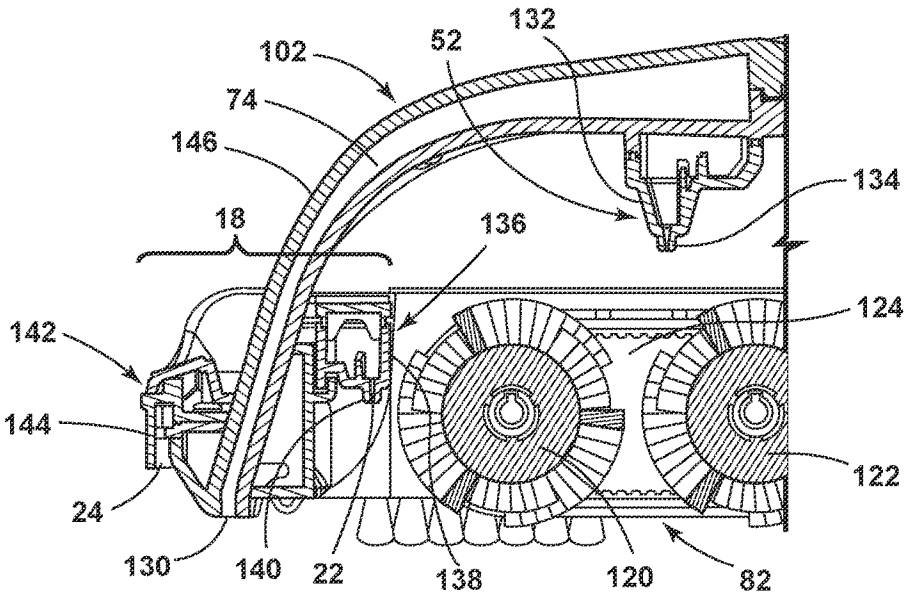
FIG. 4 is a cross-sectional view of the base taken through line IV-IV of FIG. 3.

Referring to FIGS. 3 and 4, the suction nozzle 74 can include a narrow suction pathway defined between spaced nozzle walls or covers, with an opening forming the nozzle inlet 130 at a lower end thereof. The nozzle inlet 130 is disposed forwardly of the agitator 82. It is noted that nozzle inlet 130 can be a single opening extending substantially the entire width of the base 102, or a plurality of smaller openings separated by ribs as shown in FIG. 3, the ribs serving to reinforce the suction nozzle 74.

The liquid dispenser 52 includes a spray manifold 132 having multiple outlets 134 that deliver liquid cleaning fluid between the brushrolls 120, 122. The spray manifold 132 can have a plurality of spray tips that project downwardly in the area between the brushrolls 120, 122, each spray tip defining one outlet 134. In some configurations, the outlets 134 may dispense liquid cleaning fluid onto a portion of the brushrolls 120, 122, in addition to or instead of dispensing liquid cleaning fluid onto the surface to be cleaned underneath the base 102. In another embodiment, a single horizontally-rotating brushroll is provided, and the spray manifold 132 can be disposed in front of, behind, or over the top of the brushroll.

To distribute steam, the steam distributor 18 can include a heated liquid dispenser 136 comprising multiple heated liquid outlets 22 that deliver heated liquid onto the surface to be cleaned underneath the base 102. The heated liquid dispenser 136 is provided within the interior of the base 102, such as within the brush chamber 124, and is disposed in front of the brushrolls 120, 122 and behind the suction nozzle 74. As such, when moving the base 102 in a forward cleaning stoke, heated liquid is dispensed to the surface to be cleaned before the surface is agitated by the brushrolls 120, 122. In another embodiment of the extraction cleaner 10, a single horizontally-rotating brushroll is provided, and the heated liquid dispenser 136 can be disposed in front of the single brushroll.

The heated liquid dispenser 136 includes a manifold 138 having multiple outlets 22 spaced along its length. The manifold 138 can be transversely-elongated to encourage heated liquid to spread across the length of the heated liquid dispenser 136 to distribute heated liquid evenly to each outlet 22.

The manifold 138 can have a plurality of dispensing tips 140 that project downwardly, each tip 140 defining one heated liquid outlet 22. In some configurations, the tips 140, or at least the outlets 22 of the tips 140, are disposed in the brush chamber 124. When viewed from the bottom as shown in FIG. 3, the tips 140 are disposed in a row located in front of the front brushroll 120. As such, on a forward stroke of the base 102, heated liquid is dispensed to the surface to be cleaned before the surface is agitated by the brushrolls 120, 122.

Alternatively to having a plurality of outlets 22 and/or tips 140, the heated liquid dispenser 136 can have a single, narrow slit-like opening, a plurality of slits or openings of other shapes, including a plurality of openings of uniform or varying size.

To distribute steam vapor, the steam distributor 18 can include a vapor dispenser 142 having a vapor manifold 144 positioned at a front of the base 102 and comprising the steam vapor outlet 24 that dispenses steam vapor in front of the suction nozzle 74. In this location, the steam adds wet heat to the surface to be cleaned, which can soak into the surface to be cleaned to pre-wet and soften stains and soils. Also, in cases where the steam distributor 18 dispenses visible steam, the visible steam is output within a line of sight of the user, thereby offering a visual confirmation to the user that steam is being generated and dispensed by the extraction cleaner 10. Further, since the heated liquid dispenser 136 is hidden under the base 102, the visible steam also offers a visual confirmation to the user that heated liquid is being generated and dispensed by the extraction cleaner 10.

The vapor manifold 144 can be transversely-elongated to encourage steam vapor to spread across the length of the vapor dispenser 142 to distribute steam vapor evenly across substantially the width of the base 102. The vapor manifold 144 can further be disposed in front of the heated liquid dispenser 136 and in front of the brushrolls 120, 122. In another embodiment of the extraction cleaner 10, a single horizontally-rotating brushroll is provided, and the vapor manifold 144 can be disposed in front of the single brushroll.

The vapor dispenser 142 generally distributes steam vapor downwardly toward the surface to be cleaned, although it is understood that the steam vapor may or may not reach the surface to be cleaned, as at least a portion of the steam vapor exiting the outlet 24 may rise away from the surface.

The vapor dispenser 142 can have a single, narrow slit-like opening forming the steam vapor outlet 24. In one embodiment, the steam vapor outlet 24 can be elongated in a direction parallel to a rotational axis of one or both of the brushrolls 120, 122. Alternatively to having one outlet 24, the vapor dispenser 142 can have a plurality of slits or openings of other shapes, including a plurality of openings of uniform or varying size.

Referring to FIG. 4, generally, the steam distributor 18 is disposed forwardly of the liquid dispenser 52 and forwardly of the agitator 82. More specifically, the heated liquid outlet 22 of the steam distributor 18 is forward of the liquid dispenser 52 and the agitator 82, and the steam vapor outlet 24 is forward of the heated liquid outlet 22. The suction nozzle 74 is disposed between the steam vapor outlet 24 and the heated liquid outlet 22.

The manifold 144 of the steam vapor dispenser 142 can be positioned on an exterior surface of the suction nozzle 74 and/or on an exterior surface of the base 102. In some embodiments, the steam manifold 144 can be removable with a cover 146 of the base 102, the cover 146 defining the suction nozzle 74 and/or the brushroll chamber 124. For removal with the cover 146, the steam manifold 144 can be formed or integrated with, mounted or attached to, coupled, or otherwise joined to the cover 146.

Figure 5:
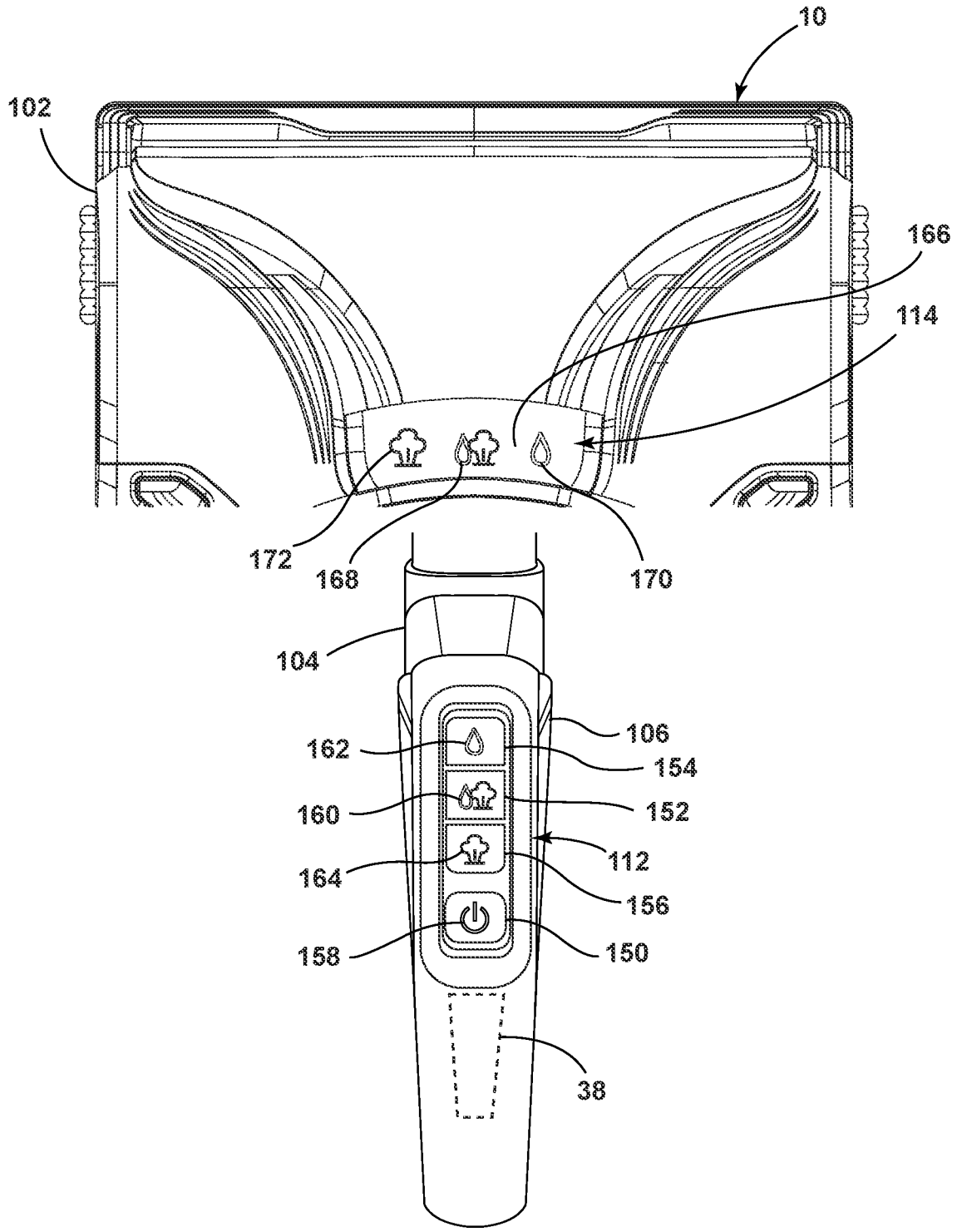
FIG. 5 is a schematic view showing user interfaces of the extraction cleaner from FIG. 2, along with a portion of a handle and base of the extraction cleaner.

FIG. 5 is a schematic view showing one configuration for the UIs 112, 114 of the extraction cleaner 10. The first UI 112 has an on/off button, e.g. a power button 150. By default, pressing the power button 150 can activate the vacuum motor 76 and the heater 16, and the extraction cleaner 10 can operate in the first cleaning mode. In another embodiment, the default-cleaning mode can be a different cleaning mode, or the last mode selected. Other default operating modes for the extraction cleaner 10 are possible, including a default mode in which pressing the power button 150 activates other electronic components of the extraction cleaner 10.

The first UI 112 has multiple mode select input controls or mode buttons, including a first button 152 to select the first cleaning mode, a second button 154 to select the second cleaning mode, and a third button 156 to select the third cleaning mode, respectively. In operation, a user can select one of the mode buttons 152-156, and the selected mode is displayed on the base 102 by the second UI 114.

The first button 152 may also be referred to herein as a steam wash or "Max Clean" button. The second button 154 may also be referred to herein as an express or "Quick Dry" button. The third button 156 may also be referred to herein as a steam only or "Pre-Treat" button.

The power button 150 and mode buttons 152, 154, 156 can have icons 158, 160, 162, 164 respectively, formed by pad printing, attaching a label, adhering a graphic, or the like, and are visible at all times to the user. In another embodiment, the mode icons 160, 162, 164 can be back-lit so that only the mode currently selected is illuminated and visible to the user. In yet another embodiment, the mode buttons 152, 154, 156 can each have an associated status indicator light to indicate when the associated mode is "on" or active.

During operation, the user can select one of the mode buttons 152, 154, 156 to change between cleaning modes. With the arrangement of the UI 112 on the handle 104, the user can conveniently hold the handle grip 106 in one hand and use the thumb of the same hand to select a desired mode. The selected cleaning mode is displayed on the base 102 by the second UI 114.

The second UI 114 includes a hidden status display 166 on the base 102 with a plurality of status indicators. The individual status indicators can each include at least one icon in the form of graphics, symbols, words, or a combination thereof. In FIG. 5, for example, the second UI 114 is shown with three status indicators, including a first status indicator comprising an icon 168 in the form of a graphic icon depicting a drop of liquid and steam, a second status indicator comprising an icon 170 in the form of a graphic depicting a drop of liquid, and a third status indicator comprising an icon 172 in the form of a graphic icon depicting steam. The different shapes of the icons 168-172 provide visual signal to the user that different modes are in operation.

The first icon 168 indicates when the extraction cleaner 10 is in the first cleaning mode, and may also be referred to herein as a steam wash or "Max Clean" icon. The second icon 170 indicates when the extraction cleaner 10 is in the second cleaning mode, and may also be referred to herein as an express or "Quick Dry" icon. The third icon 172 indicates when the extraction cleaner 10 is in the third cleaning mode, and may also be referred to herein as a steam only or "Pre-Treat" icon.

The icons 168-172 are each backlit by an illumination element (e.g. by LEDs within the base 102). To provide a further visual distinction, the icons 168-172 may illuminate in different colors. For example, the second icon 170 can illuminate in a first color (e.g., blue), and the first icon 168 and third icons 172 can illuminate in a second color (e.g., orange). This can give the user a reminder that steam is dispensed in the first and third cleaning modes, and not the second cleaning mode.

When the extraction cleaner 10 is off, the status display 166 is blank and the icons 168-172 are hidden or dead, e.g. not illuminated. When the extraction cleaner 10 is on, the icons 168-172 may selectively be illuminated and visible to the user. The status display 166 therefore shows the selected cleaning mode on the base 102.

FIG. 5 shows but one configuration for the UIs 112, 114 for the extraction cleaner 10. It is understood that other buttons, status indicators, and/or icons are possible, including having additional or fewer buttons, status indicators, and/or icons. For example, for an extraction cleaner with fewer or more cleaning modes, the first UI 112 may accordingly include fewer or more mode buttons, and the second UI 114 may accordingly include fewer or more status indicators. In another example, rather than providing a dedicated mode button for each cleaning mode, one mode button may be configured to toggle between different cleaning modes. One mode button can operate a toggle switch that cycles through different cleaning modes, toggles steam dispensing on and off, toggles the liquid flow rate between a high flow rate and a low flow rate, or any combination thereof. Other possible UI buttons, status indicators, and/or icons include, but are not limited to, other cleaning modes, battery status, Wi-Fi connection status, an empty supply container status, a full recovery container status, filter status, floor type, or any number of other status information. Examples of suitable UIs are disclosed in U.S. Patent Application No. 63/299,438, filed Jan. 14, 2022, which is incorporated herein by reference in its entirety. Other user interfaces are possible.

Figure 6:
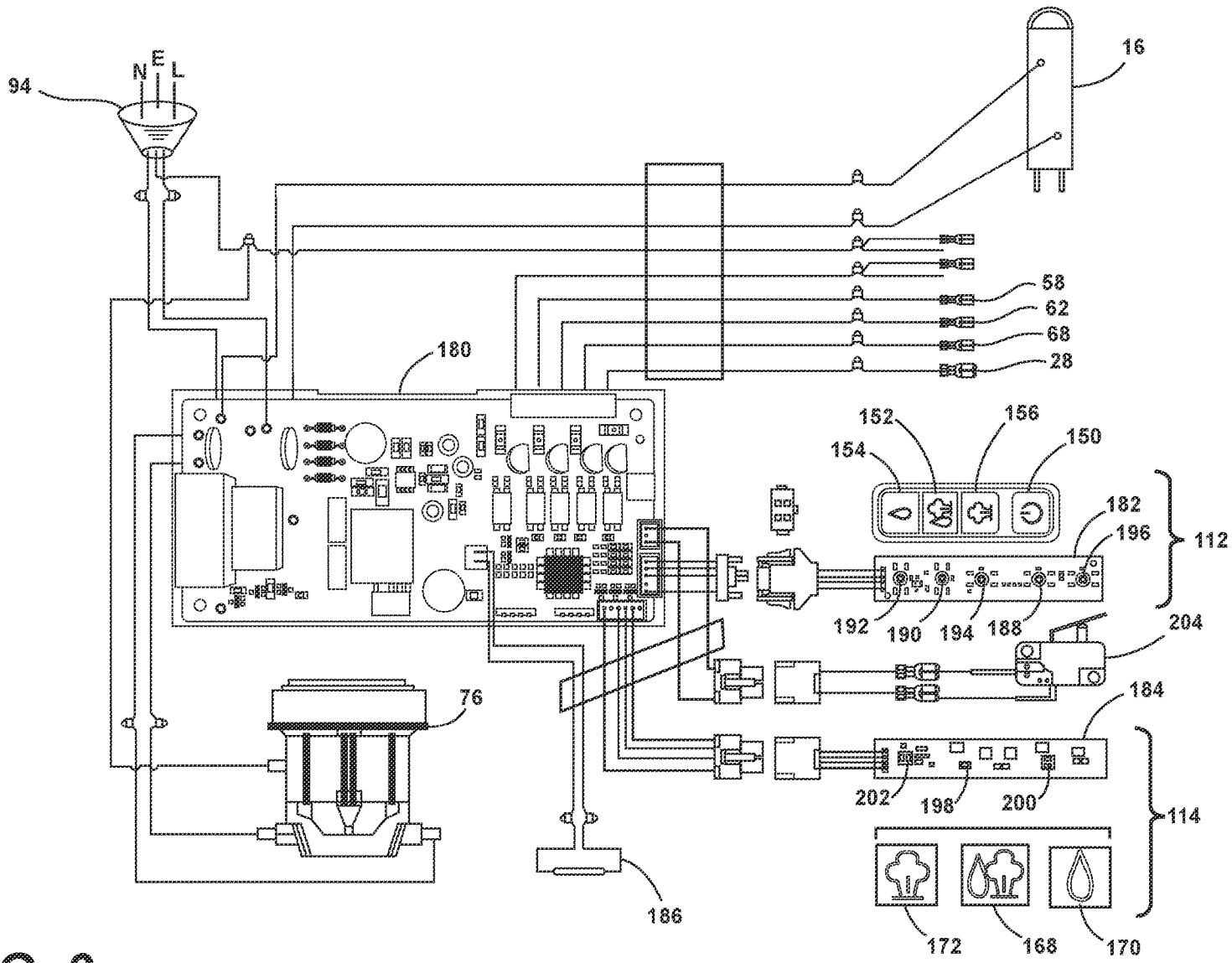
FIG. 6 is an electrical system schematic for the extraction cleaner of FIG. 1.

FIG. 6 is an electrical system schematic for the extraction cleaner 10. Power to the heater 16, steam pump 28, valves 58, 62, 68, and vacuum motor 76 is controlled by a main controller 180. The main controller 180 can include a PCB. As used herein, unless otherwise noted, the term "PCB" includes a printed circuit board having a plurality of electrical and electronic components that provide operational control to the extraction cleaner 10. The PCB includes, for example, a processing unit (e.g., a microprocessor, a microcontroller, or another suitable programmable device) and a memory (e.g., a read-only memory ("ROM"), a random access memory ("RAM"), an electrically erasable programmable read-only memory ("EEPROM"), a flash memory, or another suitable magnetic, optical, physical, or electronic memory device). The processing unit is connected to the memory and executes instructions (e.g., software) that is capable of being stored in the RAM (e.g., during execution), the ROM (e.g., on a generally permanent basis), or another non-transitory computer readable medium such as another memory or a disc. Additionally or alternatively, the memory is included in the processing unit (e.g., as part of a microcontroller). Software stored in memory includes, for example, firmware, program data, one or more program modules, and other executable instructions. The processing unit is configured to retrieve from memory and execute, among other things, instructions related to the control processes and methods described herein. The PCB can also include, among other things, a plurality of additional passive and active components such as resistors, capacitors, inductors, integrated circuits, and amplifiers. These components are arranged and connected to provide a plurality of electrical functions to the PCB including, among other things, signal conditioning or voltage regulation. For descriptive purposes, a PCB and the electrical components populated on the PCB are collectively referred to as a controller. Thus, the main PCB and the electrical components populated on the main PCB may be referred to as main controller 180.

When the extraction cleaner 10 turns on, e.g. by a user pressing the power button 150 (FIG. 5), the main controller 180 can execute the default operating mode. The main controller 180 executes the other cleaning modes upon selection of the corresponding mode button 152, 154, 156 on the user interface 112.

In some embodiments, the first user interface 112 may include a separate first user interface controller 182 and the second user interface 114 may include a separate second user interface controller 184. Such controllers 182, 184 may include PCBs. Input from the main controller 180 is provided to the UI controllers 182, 184, and vice versa.

The first user interface controller 182 can include, in one embodiment, a PCB with switches 188, 190, 192, 194 on a first surface thereof that are operated by the buttons 150, 152, 154, 156, respectively. Optionally, the PCB can include illumination elements (e.g. LEDs) on the first surface thereof that selectively emit light to illuminate the icons on the buttons 152, 154, 156. The PCB can include a trigger switch 196 on a second surface thereof that is operated by the trigger 38 (see FIGS. 1, 2, and 5). The trigger switch 196 may be a momentary switch that is closed only as long as the user depresses the trigger 38.

The second user interface controller 184 can include, in one embodiment, a PCB with illumination elements 198, 200, 202 (e.g. LEDs) on a surface thereof that selectively emit light to illuminate the icons 168, 170, 172, respectively.

Enablement of steam dispensing via the trigger 38 may be temperature-dependent. A temperature sensor 186 provides input to the main controller 180 to control when the steam pump 28 energizes to limit any unheated water from coming out of the steam distributor 18 at the beginning of operation.

The temperature sensor 186 senses temperature at the heater 16 and provides temperature input to the main controller 180. Such temperature input can be a signal or data corresponding to the actual temperature of the heater 16. Aside from this function, the temperature sensor 186 is not particularly limited, and may comprise any components and/or configurations suitable for use in/as a temperature sensor. In one embodiment, the temperature sensor 186 is a thermistor on the heater 16.

The main controller 180 can compare the temperature input to at least one threshold value, for example a predetermined minimum temperature. The minimum temperature can correspond to a minimum temperature at which a heated fluid having a minimum steam quality is produced by the heater 16. When the minimum temperature is met or exceeded, the main controller 180 powers the steam pump 28 to pressurize the steam supply path 26 and deliver steam to the steam distributor 18. Activation of the steam pump 28 is controlled by the trigger 38, via trigger switch 196, as described above. In embodiments where the steam valve 68 is included in the supply path 26, opening of the steam valve 68 is also controlled by the trigger 38, via trigger switch 196, as described above.

The minimum temperature may be, for example, about 120° C., alternatively about 130° C., alternatively about 140° C., although it is understood that the minimum temperature may vary depending on the design limits of the extraction cleaner 10 and the desired quality of the dispensed heated fluid. The minimum temperature may be set based on an expected minimum operating temperature for the heater 16 that will produce heated fluid with a desired stream quality. For example, the minimum temperature can be a minimum temperature at which heated fluid having a steam quality of about 20% to about 30%, alternately about 24% is produced by the heater 16.

The extraction cleaner 10 can include at least one indicator to indicate to the user when the heater 16 is warming up and steam is ready and available for dispensing. The indicator can be mode-dependent. In one embodiment, for the first cleaning mode, the indicator is the first icon 168 and for the third cleaning mode the indicator is the third icon 172. During the warm-up period after turning the heater 16 on via the power button 150 during which steam is not available to be dispensed, one of the icons 168, 172 can be illuminated in a first state. Once the heater 16 reaches the minimum temperature as determined by the temperature sensor 186, and the main controller 180 powers the steam pump 28, the icon 168, 172 can be illuminated in a second state. Various illumination states are contemplated, including, but not limited to being illuminated in an animated state, e.g. with a changing pattern and/or changing characteristics over time, during warm-up and in a steady state, e.g., with generally continuous, unchanging characteristics over a period of time, when steam is ready, and/or being illuminated in a first color during warm-up and in a second color when steam is ready. Various animations are contemplated, including, but not limited to, a flashing animation. In a flashing animation, light intensity generally varies in a square wave fashion or in some other non-sinusoidal manner. This change in state can be based on input from the temperature sensor 186.

In some embodiments, the main controller 180 can compare the temperature input to at least one other threshold value, for example a predetermined maximum temperature. The maximum temperature can be a temperature at which the heater 16 may operate within the design limits of the surrounding components of the extraction cleaner 10, and may also be a threshold above which heater 16 need not operated to produce a desired steam output for effective cleaning. When the maximum temperature is met or exceeded, the main controller 180 cuts off power to the heater 16 to allow the heater 16 to cool. Once the temperature of the heater 16 drops below the maximum temperature, the controller 180 supplies power to the heater 16 and the heater 16 is energized.

The predetermined maximum temperature may be, for example, about 160° C., alternatively about 170° C., alternatively about 180° C., although it is understood that the maximum temperature may vary depending on the design limits of the extraction cleaner 10 and the desired characteristics of the dispensed steam.

The extraction cleaner 10 can include a switch 204 to de-activate one or more components when the upright body 100 is in the upright stored position. When the upright body 100 is raised to and/or locked in the upright stored position, the switch 204 communicates with the main controller 180 to lock-out or disable fluid dispensing. Aside from this function, the switch 204 is not particularly limited, and may comprise any components and/or configurations suitable for use in/as a switch. In one embodiment, the switch 204 is a normally-open (NO) switch disposed in a location to be closed when the upright body 100 is raised to and/or locked in the upright stored position. When the switch 204 closes, the main controller 180 disables fluid dispensing. Consequently, depressing the trigger 38 will not dispense liquid or steam. For example, the switch 204 can close when the joint lock (not shown) engages and locks the upright body 100 in the stored position. The switch 204 can open when the upright body 100 is reclined.

It is noted that the switch 204 disables fluid dispensing via actuation of the trigger 38. Fluid dispensing via the hose 86 and tool 88 (FIG. 1) can remain enabled when the switch 204 is closed. For example, when the extraction cleaner 10 is parked while in the first or second cleaning mode, the extraction cleaner 10 is operable in the fourth cleaning mode and liquid dispensing via the hose 86 and tool 88 (FIG. 1) remains enabled. When the extraction cleaner 10 is parked while in the third cleaning mode, e.g., the steam only cleaning mode, the extraction cleaner 10 enters a stand-by mode in which the extraction cleaner 10 remains powered on but no cleaning functions are active (e.g., the heater 16, the pumps 28, 60, and/or the vacuum motor 76 are turned off). To end the stand-by mode, the upright body 100 can be reclined to open the detent switch 204.

To the extent not already described, the different features and structures of the various embodiments of the invention, may be used in combination with each other as desired, or may be used separately. That one apparatus is illustrated herein as having all of these features does not mean that all of these features must be used in combination, but rather done so here for brevity of description. Thus, the various features of the different embodiments may be mixed and matched in various configurations as desired to form new embodiments, whether or not the new embodiments are expressly described.

While primarily discussed herein in terms of an extraction cleaner, aspects of the extraction cleaner disclosed herein are applicable to other types of surface cleaning apparatus, including any surface cleaning apparatus having a fluid delivery system for storing cleaning fluid (e.g. liquid) and delivering the cleaning fluid (e.g. liquid and/or steam) to the surface to be cleaned.

The terms "comprising" or "comprise" are used herein in their broadest sense to mean and encompass the notions of "including," "include," "consist(ing) essentially of," and "consist(ing) of. The use of "for example," "e.g.," "such as," and "including" to list illustrative examples does not limit to only the listed examples. Thus, "for example" or "such as" means "for example, but not limited to" or "such as, but not limited to" and encompasses other similar or equivalent examples.

The above description relates to general and specific embodiments of the disclosure. However, various alterations and changes can be made without departing from the spirit and broader aspects of the disclosure as defined in the appended claims, which are to be interpreted in accordance with the principles of patent law including the doctrine of equivalents. As such, this disclosure is presented for illustrative purposes and should not be interpreted as an exhaustive description of all embodiments of the disclosure or to limit the scope of the claims to the specific elements illustrated or described in connection with these embodiments. Any reference to elements in the singular, for example, using the articles "a," "an," "the," or "said," is not to be construed as limiting the element to the singular.

Likewise, it is also to be understood that the appended claims are not limited to express and particular compounds, compositions, or methods described in the detailed description, which may vary between particular embodiments that fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

The invention claimed is:

1. An extraction cleaner comprising:

a housing having a portion adapted for movement over a surface to be cleaned;

a fluid recovery system comprising a suction nozzle, a recovery container, and a vacuum motor;

a fluid supply container configured to store a supply of a cleaning fluid;

a steam delivery system comprising:

a heater in fluid communication with the fluid supply container; and a steam distributor;

a liquid delivery system comprising a liquid dispenser; and a user interface on the housing to select one of a plurality of modes of operation of the extraction cleaner, the plurality of modes of operation comprising at least:

a first cleaning mode in which liquid is dispensed from the liquid dispenser and steam is dispensed from the steam distributor;

a second cleaning mode in which liquid is dispensed from the liquid dispenser and steam is not dispensed from the steam distributor; and a third cleaning mode in which steam is dispensed from the steam distributor and liquid is not dispensed from the liquid dispenser.

2. The extraction cleaner of claim 1, wherein the steam distributor is a dual-phase distributor comprising:

a heated fluid inlet in fluid communication with the heater to receive heated fluid from the heater;

a phase separator separating a vapor phase of the heated fluid from a liquid phase of the heated fluid;

a heated liquid outlet in fluid communication with the phase separator to dispense the liquid phase of the heated fluid to the surface to be cleaned as heated liquid; and a steam vapor outlet in fluid communication with the phase separator to dispense the vapor phase of the heated fluid as steam vapor.

3. The extraction cleaner of claim 2, wherein at least the steam vapor outlet is located on an exterior of the suction nozzle.

4. The extraction cleaner of claim 1, wherein in the first cleaning mode, the steam distributor separately dispenses steam vapor and heated liquid droplets.

5. The extraction cleaner of claim 1, wherein:

the liquid delivery system comprises:

a first liquid supply path to deliver cleaning fluid at a first flow rate to the liquid dispenser; and a second liquid supply path to deliver cleaning fluid at a second flow rate to the liquid dispenser, wherein the first flow rate is higher than the second flow rate;

liquid is dispensed through the first liquid supply path in the first cleaning mode; and liquid is dispensed through the second liquid supply path in the second cleaning mode.

6. The extraction cleaner of claim 5, comprising a manifold splitter in fluid communication with an outlet of the fluid supply container, the manifold splitter comprising:

a first outlet in fluid communication with a steam supply path including the heater and the steam distributor a second outlet in fluid communication with the first liquid supply path; and a third outlet in fluid communication with the second liquid supply path.

7. The extraction cleaner of claim 5, wherein;

the steam delivery system comprises a steam supply path comprising a first pump in fluid communication with the heater;

the first liquid supply path comprises a second pump and a first liquid valve to control a flow of cleaning liquid to the liquid distributor; and the first liquid supply path comprises a second liquid valve to control a flow of cleaning liquid to the liquid distributor; and optionally, the steam delivery system comprises a steam valve to control a flow of steam to the steam distributor.

8. The extraction cleaner of claim 7, comprising a trigger controlling the first pump, first liquid valve, and second liquid valve, wherein:

the trigger is configured to open the first liquid valve and activate the first pump in the first cleaning mode;

the trigger is configured to open the second liquid valve in the second cleaning mode; and the trigger is configured to activate the first pump in the third cleaning mode.

9. The extraction cleaner of claim 7, wherein the user interface comprises:

a first mode button to select the first cleaning mode, wherein selection of the first mode button operably couples a trigger with the first pump and the first liquid valve;

a second mode button to select the second cleaning mode, wherein selection of the second mode button operably couples the trigger with the second liquid valve; and a third mode button to select the third cleaning mode, wherein selection of the third mode button operably couples the trigger with the first pump.

10. The extraction cleaner of claim 9, wherein:

selection of at least one of the first mode button and the second mode button activates the second pump; and selection of the third mode button de-activates at least one of the second pump and the vacuum motor.

11. The extraction cleaner of claim 1, wherein the steam delivery system comprises a pressure relief device in a steam supply path between the fluid supply container and the heater to limit the pressure in the supply path, the pressure relief device configured to open at a predetermined set pressure.

12. The extraction cleaner of claim 1, comprising at least one brushroll, and the liquid dispenser is positioned to dispense the cleaning fluid toward the at least one brushroll.

13. The extraction cleaner of claim 12, wherein the steam distributor is positioned forwardly of the at least one brushroll.

14. The extraction cleaner of claim 1, wherein the steam distributor comprises a heated liquid dispenser and a steam dispenser, wherein the steam dispenser is positioned on an exterior of the base and the heated liquid dispenser is located within an interior of the base.

15. The extraction cleaner of claim 14, wherein the steam dispenser is positioned forwardly of the suction nozzle and the heated liquid dispenser is positioned rearwardly of the suction nozzle.

16. The extraction cleaner of claim 1, comprising:

a pump in fluid communication with the heater;

a controller to control a supply of power to the pump; and a temperature sensor to sense temperature at the heater and provide temperature sensor data to the controller, wherein the controller is configured to power the pump at a predetermined minimum temperature.

17. The extraction cleaner of claim 16, wherein the controller is configured to cut off power to the heater at a predetermined maximum temperature.

18. The extraction cleaner of claim 1, wherein the user interface comprises:

a power button to activate and de-activate at least one electrical component of the extraction cleaner and to initiate a default mode of operation;

a first mode button to select the first cleaning mode;

a second mode button to select the second cleaning mode; and a third mode button to select the third cleaning mode.

19. The extraction cleaner of claim 18, wherein the housing comprises:

a base adapted for movement across a surface to be cleaned; and an upright assembly that is pivotally connected to the base for directing the base across the surface to be cleaned, wherein the user interface is disposed on the upright assembly; and a status display on the base, the status display having a plurality of status indicators representing the plurality of modes of operation comprising at least:

a first status indicator configured to illuminate in the first cleaning mode;

a second status indicator configured to illuminate in the second cleaning mode; and a third status indicator configured to illuminate in the third cleaning mode.

20. The extraction cleaner of claim 19, wherein the status display is structured so that when the extraction cleaner is off, the status display is blank, and when the extraction cleaner is on, one of the plurality of status indicators corresponding to a selected one of the plurality of modes of operation is illuminated and visible to a user.

* * * * *